US007384129B2

(12) United States Patent
Nagata et al.

(10) Patent No.: US 7,384,129 B2
(45) Date of Patent: Jun. 10, 2008

(54) INK JET RECORDING HEAD, INK JET CARTRIDGE COMPRISING RECORDING HEAD, AND METHOD FOR REFILLING INK CARTRIDGE WITH INK

(75) Inventors: Shingo Nagata, Machida (JP); Keiichiro Tsukuda, Yokohama (JP); Haruyuki Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 225 days.

(21) Appl. No.: 11/141,000

(22) Filed: Jun. 1, 2005

(65) Prior Publication Data

US 2005/0280669 A1 Dec. 22, 2005

(30) Foreign Application Priority Data

Jun. 2, 2004 (JP) ..... 2004-164554
May 17, 2005 (JP) ..... 2005-144032

(51) Int. Cl.
*B41J 2/21* (2006.01)

(52) U.S. Cl. ..... 347/43; 347/40; 347/41

(58) Field of Classification Search ..... 347/40–43
See application file for complete search history.

(56) References Cited

U.S. PATENT DOCUMENTS 5,745,131 A 4/1998 Kneezel et al.
6,030,065 A 2/2000 Fukuhata ..... 347/15
6,137,502 A 10/2000 Anderson et al. ..... 347/15
6,382,757 B1 * 5/2002 Kakutani ..... 347/15
6,702,415 B2 * 3/2004 Kanda et al. ..... 347/15
6,830,317 B2 * 12/2004 Tsuchii et al. ..... 347/56
6,860,586 B2 * 3/2005 Ishikura ..... 347/43
6,863,374 B2 * 3/2005 Yamazaki et al. ..... 347/43
7,011,391 B2 * 3/2006 Otsuka et al. ..... 347/43
7,025,438 B2 * 4/2006 Murakami et al. ..... 347/43
7,048,357 B2 * 5/2006 Sato ..... 347/41
7,090,332 B2 * 8/2006 Konno et al. ..... 347/43
2002/0163557 A1 * 11/2002 Du et al. ..... 347/43
2003/0214551 A1 11/2003 Yabe
2004/0021731 A1 * 2/2004 Yabe et al. ..... 347/40

OTHER PUBLICATIONS

Office Action in Canadian Application No. 2,508,868, dated Dec. 5, 2007.

* cited by examiner

*Primary Examiner*—Matthew Luu
*Assistant Examiner*—Joshua M Dubnow
(74) *Attorney, Agent, or Firm*—Fitzpatrick, Cella, Harper & Scinto

(57) ABSTRACT

An ink jet recording head includes three sets of nozzle arrays each having a large nozzle array including a first ejection outlet group and an adjacent small nozzle array including a second ejection outlet group. The ejection outlets of the second ejection outlet group have smaller diameters than those of the first ejection outlet group. In nozzle arrays constituted by two adjacent ones of the three nozzle array sets, a large nozzle array, a small nozzle array, a small nozzle array, and a large nozzle array are arranged in the order named, in the main scanning direction. One of the two adjacent nozzle array sets ejects cyan ink, the other one of the two adjacent nozzle array sets ejects magenta ink, and a nozzle array set other than the two adjacent nozzle array sets ejects yellow ink.

9 Claims, 10 Drawing Sheets

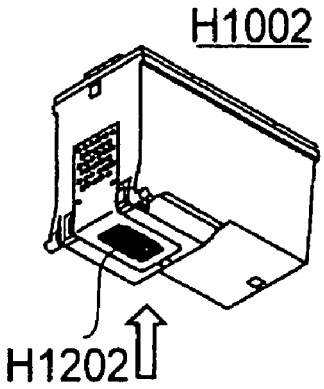
FIG. 7A
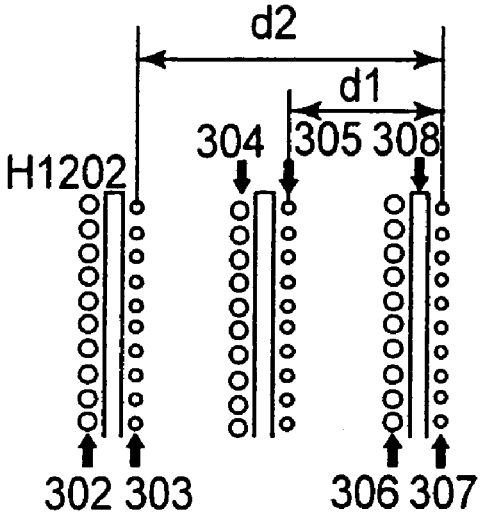
FIG. 7B
FIG. 8A
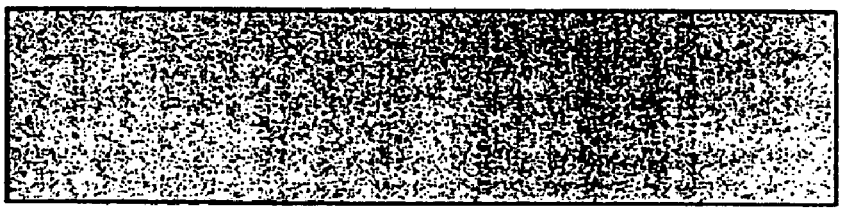
FIG. 8B
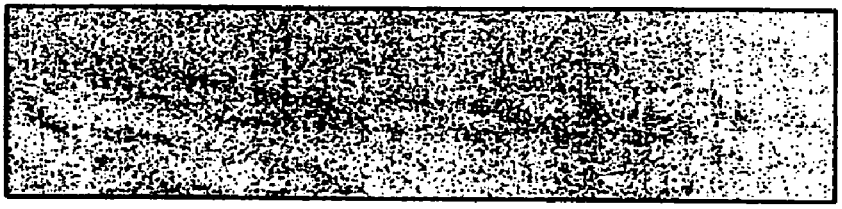
FIG. 8C
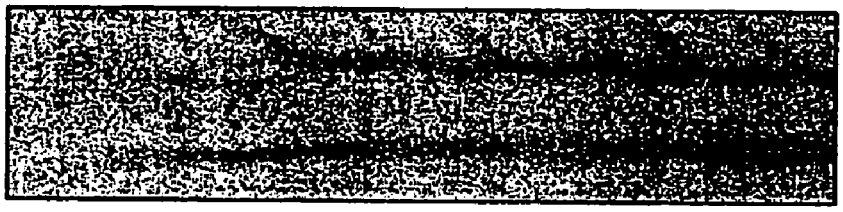

| | | | |
|---|---|---|---|
|  | 303+305<br>C+M | 303+307<br>C+Y | 305+307<br>M+Y |
| | △ | ○ | ○ |
|  | 303+305<br>C+Y | 303+307<br>C+M | 305+307<br>Y+M |
| | ○ | × | ○ |

| | | | |
|---|---|---|---|
|   | 403+404<br>C+M | 403+406<br>C+Y | 404+406<br>M+Y |
| | ○ | ○ | ○ |
|   | 403+404<br>M+C | 403+406<br>M+Y | 404+406<br>C+Y |
| | ○ | ○ | ○ |

| | | | |
|---|---|---|---|
|   | 403+404<br>C+M | 403+406<br>C+Y | 404+406<br>M+Y |
| | ○ | ○ | ○ |
|   | 403+404<br>M+C | 403+406<br>M+Y | 404+406<br>C+Y |
| | ○ | ○ | ○ |

INK JET RECORDING HEAD, INK JET CARTRIDGE COMPRISING RECORDING HEAD, AND METHOD FOR REFILLING INK CARTRIDGE WITH INK

FIELD OF THE INVENTION AND RELATED ART

The present invention relates to an ink jet recording head which records images by ejecting liquid such as ink, an ink jet cartridge comprising such a recording head, and a method for refilling such an ink jet cartridge with ink. More specifically, the present invention relates to an ink jet recording head which ejects minuscule liquid droplets, an ink jet cartridge comprising such an ink jet recording head, and a method for refilling such an ink jet cartridge with ink.

Not only are the ink jet recording heads in accordance with the present invention compatible with ordinary printing apparatuses, but also, with such apparatuses as copying machines, facsimile machines comprising a communication system, wordprocessors having a printing portion, multi-functional recording apparatuses made up of a combination of two or more of the preceding apparatuses, etc.

In order to record a color image equal in quality to one obtained by silver salt photography, with the use of an ink jet recording head, it is necessary to form, on a recording medium, dots that are visually unrecognizable as dots (dots so small that areas of image covered with dots do not appear grainy). In order to obtain such color images, recording heads able to eject ink droplets roughly 5 pl (pico-liter: $10^{-12}$ liters) in ink droplet volume, 40-50 μm in dot diameter, and 600×1,200-1,200×1,200 dpi in resolution (dpi is number of dots per inch), have been put to practical use.

However, in order to satisfy users who desire to further reduce the graininess of the halftone areas and/or highlight areas of a color photograph, it is necessary to eject ink droplets much smaller in volume than the above-mentioned value, more specifically, ink droplets roughly 2 pl in volume. Enabling and causing an ink jet recording head to eject such small ink droplets is effective to meet the above-described need of the users. However, this reduces the printing speed of the ink jet recording head, having therefore an adverse effect upon the ability to print at a high speed. In fact, it unnecessarily slows down the printing speed even when printing color images which do not require a high level of resolution.

Thus, various means for obtaining high quality images at a high speed have been proposed. For example, an ink jet recording head for ejecting ink droplets is structured so that it can eject plural types of ink droplets different in size, for example, ink droplets which are roughly 5 pl in volume, and ink droplets which are roughly 2 pl in volume. Thus, when recording such color images as accounting tables, graphs, etc., which do not require high resolution, the ink jet recording head is made to eject ink droplets which are roughly 5 pl, whereas when forming highly precise photographic color images, for example, digital photographic images based on the data from such a digital device as a digital camera, a color scanner, etc., the ink jet recording head is made to eject ink droplets of a relatively smaller size, for example, roughly 2 pl in volume.

As for the structural design for an ink jet recording head, according to which an ink jet recording head is provided with plural sets of nozzles for ejecting ink droplets of different volumes, the following have been known.

For example, the specification of U.S. Pat. No. 6,137,502 discloses an ink jet recording head provided with two sets of ejection orifices, which are different in respect of the size of the ejected ink droplets, and in which the ejection orifices are arranged in a zig-zag pattern.

The specification of U.S. Pat. No. 6,030,065 discloses an ink jet recording head provided with two sets of nozzles, that is, a first set of nozzles which are adjustable in respect of the diameter of the ejected ink droplet in order to adjust in diameter, within a predetermined range, the dot which the ink droplet forms on the recording medium, and a second set of nozzles which also are adjustable in respect of the diameter of the ejected ink droplet in order to adjust in diameter, within a predetermined range, the dot which the ink droplet forms on the recording medium. Further, the first and second sets of nozzles are different in the predetermined range in which they are adjustable in respect of the ink droplet diameter, although their ranges partially overlap. This specification discloses another structural design for an ink jet recording head, shown in FIG. 1, according to which the recording head comprises recording head portions 10Y, 10M, 10C, and 10K, for ejecting yellow, magenta, cyan, and black inks, respectively, and each recording head portion is provided with two sets of nozzles, that is, a set of smaller nozzles 12 disposed in a straight line parallel to the secondary scanning direction (subscan direction; arrow "b") and a set of larger nozzles 14 disposed in a straight line parallel to the secondary scanning direction (plural straight lines of small and large nozzles are rendered parallel); and, in terms of the direction perpendicular to the lines of nozzles, that is, the primary scanning direction (main scan direction; arrow "a"), the small and large nozzles are alternately placed.

Further, the specification of U.S. Patent Application Publication No. 2003/0214551 discloses an ink jet recording head which has a plurality of ink supply openings for supplying ink ejection orifices with ink, and has a first set of nozzles for ejecting liquid droplets of a larger size, and a second set of nozzles for ejecting liquid droplets smaller in size than the liquid droplets ejected by a nozzle of the first set. The first nozzle set is made up of a plurality of first nozzles, and the second nozzle set is made up of a plurality of second nozzles. The first and second nozzle sets are disposed between two adjacent ink supply openings. Further, the specification of U.S. Patent Application Publication No. 2004/021731 discloses an ink jet recording head having a plurality of (two) sets of first nozzles disposed in a straight line, and a set of second nozzles disposed in a straight line between the two sets of first nozzles. The set of first nozzles ejects liquid droplets larger in size than those ejected by the set of second nozzles.

Thus, the inventors of the present invention made an ink jet recording head, in which the nozzles were disposed as shown in FIG. 1, the amount of ink ejected by each of the plurality of nozzles 12 having the smaller diameter was 2 pl, and the amount of ink ejected by each of the plurality of nozzles 14 having the larger diameter was 5 pl. Then, recording was made using this ink jet recording head. As a result, the following tendencies were discovered: when printing solid images of the secondary color(s) created by the combination of magenta and cyan inks, the nonuniformity of the solid images was more conspicuous. This is thought to be for the following reason. The smaller the size of the primary ink droplet, the smaller the difference in size between the primary ink droplet and the satellite ink droplet which forms as the primary ink droplet is ejected. Further, the smaller in size the primary ink droplet, the greater the number of satellite ink droplets which form as the primary ink droplet is ejected.

As for the method for eliminating the above-described problem, it is effective to increase the number of passes used for forming an image. However, this method directly lengthens the printing time, being therefore not desirable for forming high quality images at a high speed.

Thus, the inventors of the present invention studied the mechanism responsible for the formation of a nonuniform image, and the method for eliminating the above-described problem, based on a fresh point of view, that is, an unconventional standpoint, discovering thereby an innovative solution to the above-described problem, that is, a method of eliminating the above-described problem by devising a particular nozzle arrangement, in particular, an arrangement for the nozzles that eject liquid droplets of the smaller size.

SUMMARY OF THE INVENTION

The primary object of the present invention is to solve the above-described problem regarding the secondary color, with the use of a method totally different from any of the conventional methods, in order to provide an ink jet recording head capable of forming high quality images at a high speed, an ink jet cartridge comprising such an ink jet recording head, a method for refilling such an ink jet cartridge with ink, and an ink jet recording apparatus usable with said ink jet recording head or with said ink jet cartridge.

According to an aspect of the present invention, there is provided an ink jet recording head comprising three sets of nozzle arrays each of which comprises a large nozzle array which includes a first ejection outlet group and a small nozzle array which includes a second ejection outlet group, said small nozzle array being adjacent to said large nozzle array, wherein said first ejection outlet group includes an ejection outlet for ejecting ink, and said second ejection outlet group includes an ejection outlet, having an ejection outlet diameter smaller than said ejection outlet in said first ejection outlet group, for ejecting ink, wherein yellow, magenta and cyan inks are ejected to effect recording by said nozzle array sets when said ink jet recording head is moved in a main scan direction at a position opposing a recording medium which is moving in a sub-scan direction, wherein in nozzle arrays constituted by two adjacent ones of said three nozzle array sets, a large nozzle array, a small nozzle array, a small nozzle array, and a large nozzle array are arranged in the order named, in the main scanning direction, and wherein one of said two adjacent nozzle array sets ejects the cyan ink, the other one of said two adjacent nozzle array sets ejects the magenta ink, and a nozzle array set other than said two adjacent nozzle array sets ejects the yellow ink.

According to another aspect of the present invention, there is provided an ink jet cartridge comprising three sets of nozzle arrays each of which comprises a large nozzle array which includes a first ejection outlet group and a small nozzle array which includes a second ejection outlet group, said small nozzle array being adjacent to said large nozzle array, and an ink accommodating portion for accommodating ink to be supplied to said ink jet recording head, wherein said first ejection outlet group includes an ejection outlet for ejecting ink, and said second ejection outlet group includes an ejection outlet, having an ejection outlet diameter smaller than said ejection outlet in said first ejection outlet group, for ejecting ink, wherein yellow, magenta and cyan inks are ejected to effect recording by said nozzle array sets when said ink jet recording head is moved in a main scan direction at a position opposing a recording medium which is moving in a sub-scan direction, wherein in nozzle arrays constituted by two adjacent ones of said three nozzle array sets, a large nozzle array, a small nozzle array, a small nozzle array, and a large nozzle array are arranged in the order named, in the main scanning direction, and wherein one of said two adjacent nozzle array sets ejects the cyan ink, the other one of said two adjacent nozzle array sets ejects the magenta ink, and a nozzle array set other than said two adjacent nozzle array sets ejects the yellow ink.

According to the aspects of the ink jet head and the ink cartridge, when the three inks are yellow, magenta and cyan inks, the distance between the second ejection outlet groups for ejecting the cyan ink and the magenta ink, which are relatively low in brightness is longer than the distance between the ejection outlet group for ejecting the yellow ink and the ejection outlet group for ejecting the magenta or cyan ink.

According to a further aspect of the present invention, there is provided a method for injecting ink into an ink jet cartridge including an ink jet recording head for ejecting ink and an ink accommodating portion for accommodating ink to be supplied to the recording head, said method comprising a step of preparing the ink jet cartridge including three sets of nozzle arrays each of which comprises a large nozzle array which includes a first ejection outlet group and a small nozzle array which includes a second ejection outlet group, said small nozzle array being adjacent to said large nozzle array, wherein said first ejection outlet group includes an ejection outlet for ejecting ink, and said second ejection outlet group includes an ejection outlet, having an ejection outlet diameter smaller than said ejection outlet in said first ejection outlet group, for ejecting ink, wherein yellow, magenta and cyan inks are ejected to effect recording by said nozzle array sets when said ink jet recording head is moved in a main scan direction at a position opposing a recording medium which is moving in a sub-scan direction, wherein in nozzle arrays constituted by two adjacent ones of said three nozzle array sets, a large nozzle array, a small nozzle array, a small nozzle array, and a large nozzle array are arranged in the order named, in the main scanning direction, and wherein one of said two adjacent nozzle array sets ejects the cyan ink, the other one of said two adjacent nozzle array sets ejects the magenta ink, and a nozzle array set other than said two adjacent nozzle array sets ejects the yellow ink; a step of injecting the yellow ink into a first ink accommodating portion of said one of said nozzle array sets other than said two adjacent nozzle array sets of said ink jet cartridge; a step of injecting the cyan ink into a second ink accommodating portion of one of said two adjacent nozzle array sets; and a step of injecting the magenta ink into a third ink accommodating portion of the other one of said two adjacent nozzle array sets.

With the use of the above-described method for filling the above-described ink jet cartridge with ink, it is possible to easily obtain an ink jet cartridge capable of forming an excellent image, that is, an image in which the nonuniformity of the areas formed by the secondary color(s) is inconspicuous.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 7A is a perspective view of a comparative ink jet cartridge, and FIG. 7B is a schematic drawing showing the ejection orifice arrangement on the recording element substrate mounted in the comparative ink jet cartridge.

FIGS. 8A-8C are drawings showing the differences in the nonuniformity among three images.

DETAILED DESCRIPTION OF THE PREFERRED EMBODIMENTS

Next, the preferred embodiments of the present invention will be described with reference to the appended drawings.

First, (1) the ink jet cartridge, and (2) the ink jet recording apparatus employing the ink jet cartridge (1), will be described in detail.

Figure 1:
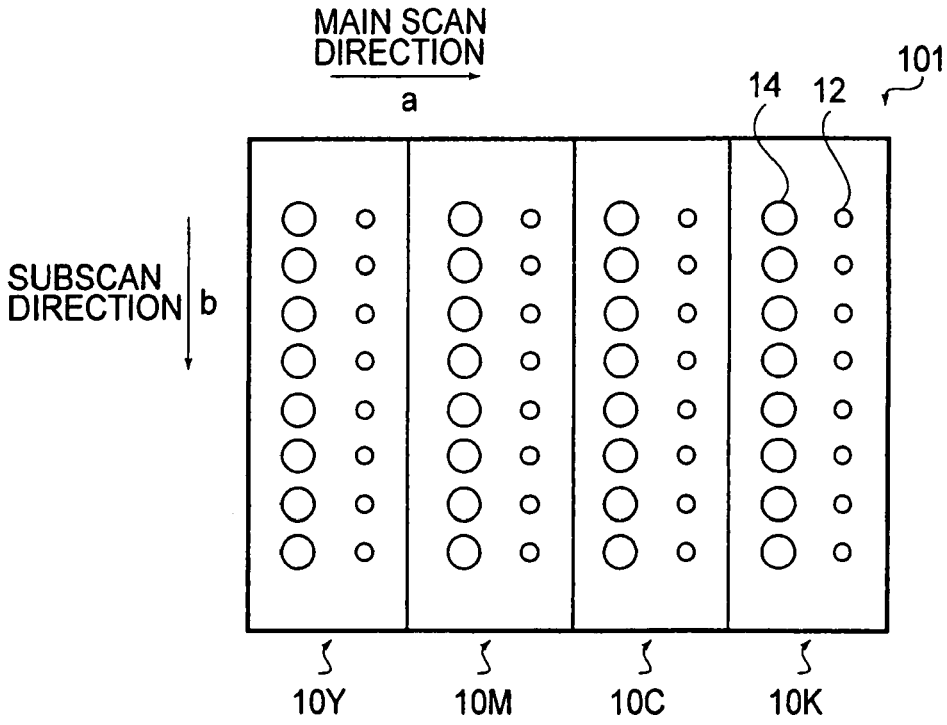
FIG.1 PRIOR ART
FIG. 1 is a drawing showing an example of the nozzle arrangement in a typical ink jet recording apparatus in accordance with the prior art.
Figures 2A, 2B:
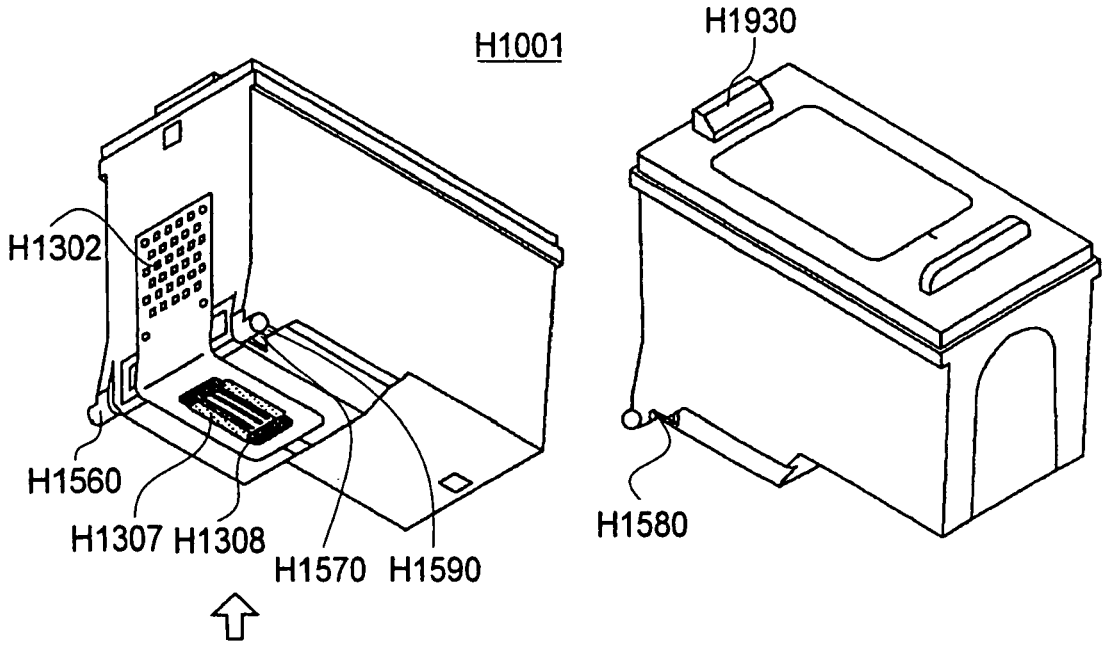
FIG. 2A is a perspective view of an ink jet cartridge in accordance with the present invention.
FIG. 2B is a perspective view of the same ink jet cartridge as the one shown in FIG. 2A, as seen from a direction different from the direction in which the cartridge is seen in FIG. 2A.

Referring to FIGS. 2A and 2B, the ink jet cartridge in accordance with the present invention comprises an ink jet recording head for ejecting ink, and an ink container for storing the ink to be supplied to the ink jet recording head. The ink jet recording head and ink container are integrated in an ink jet cartridge H1001. The ink jet cartridge H1001 contains color inks (cyan, magenta, and yellow inks). The ink jet cartridge H1001 is removably mounted on a carriage 102 of the main assembly of the ink jet recording apparatus shown in FIG. 6, being precisely positioned relative to the carriage 102 by a positioning means, and is electrically connected to the main assembly through a plurality of electrical contacts. It is replaced when the ink therein is depleted by consumption.

(1) ink Jet Cartridge

The ink jet cartridge H1001 in this embodiment is a recording head employing a plurality of electrothermal transducing elements which generate the thermal energy for causing the ink to boil in the so-called film boiling fashion in response to electrical signals, and an ink container integral with the recording head. The recording head portion is of the so-called side shooter type, in which the plurality of electrothermal transducing elements directly oppose a plurality of ejection orifices for ejecting ink droplets, one for one.

Figure 3A:
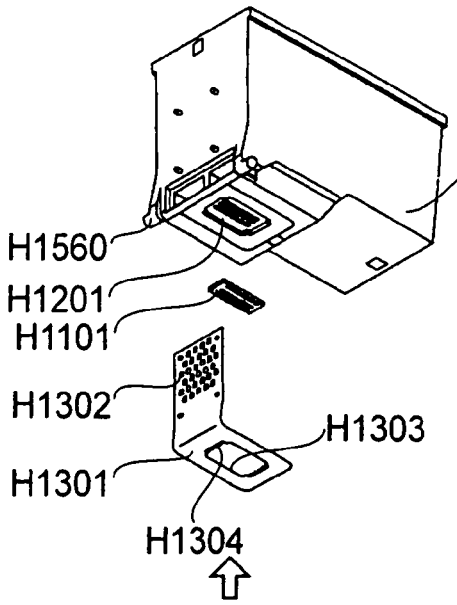
FIG. 3A is an exploded perspective view of the ink jet cartridge shown in FIGS. 2A and 2B, as seen from the same direction as the direction from which the cartridge is seen in FIG. 2A.
Figure 3B:
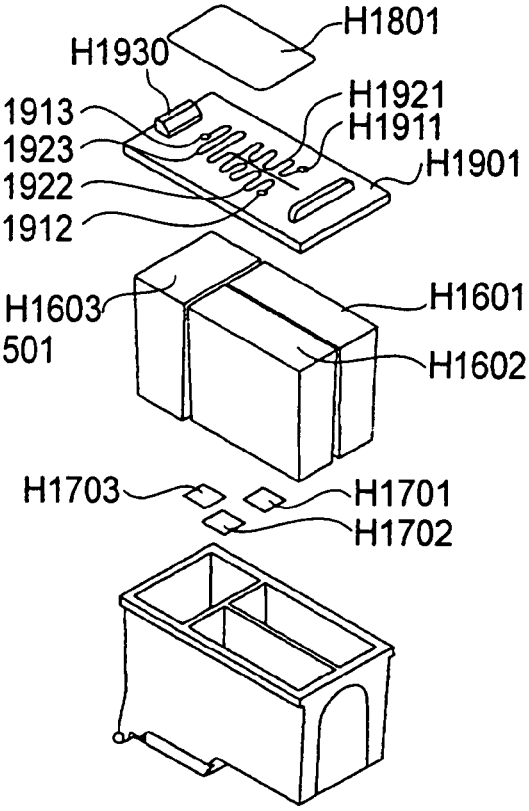
FIG. 3B is an exploded perspective view of the same ink jet cartridge, as seen from the same direction as the direction from which the cartridge is seen in FIG. 2B.

The ink jet cartridge H1001 is for ejecting such color inks as cyan, magenta, yellow inks, etc. Referring to FIGS. 3A and 3B, which are exploded perspective views of the ink jet cartridge H1001, the ink jet cartridge H1001 comprises a recording element substrate H1101, an electric wire tape H1301, an ink supply holding member H1501, filters H1701, H1702, and H1703, ink absorbent members H1601, H1602, and H1603, a cover H1901, and a sealing member H1801. Although this embodiment will be described with reference to the ink jet cartridge H1001, which is structured for ejecting three inks different in type, the application of the present invention is not limited to the ink jet cartridge H1001, and the like. Rather, the present invention is applicable to any ink jet cartridge as long as the ink jet cartridge is agreeable with the gist of the present invention.

(1-1) Recording Element Substrate

Figure 4:
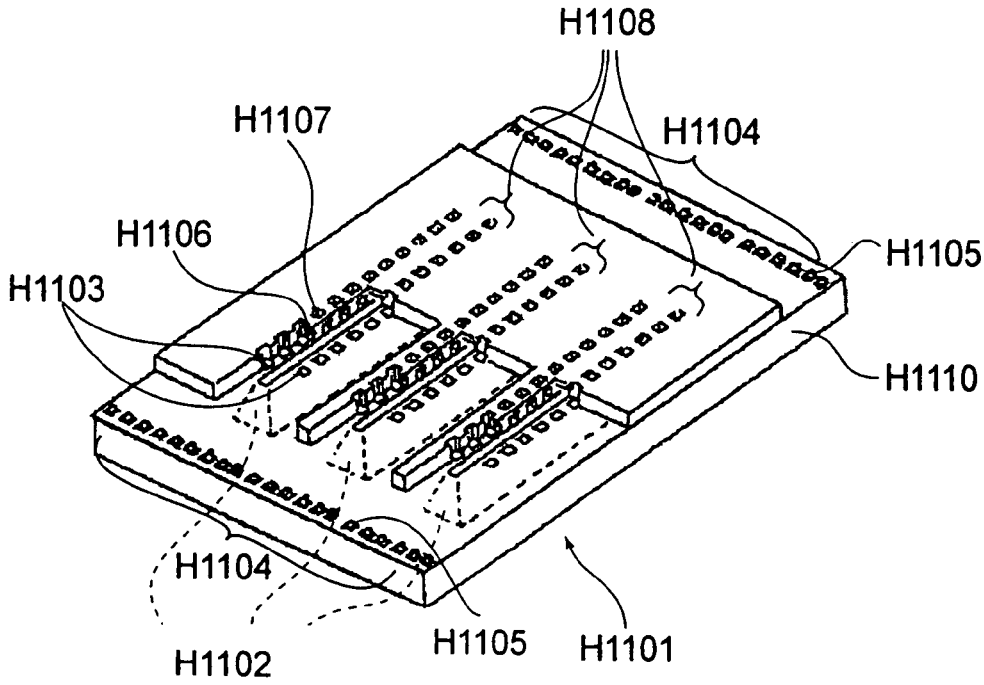
FIG. 4 is a partially cutaway perspective view of the recording element substrate of the ink jet cartridge shown in FIGS. 2A and 2B.

FIG. 4 is a partially cutaway perspective view of the recording element substrate, for describing the structure thereof. The recording element substrate H1101 is provided with three ink supply openings H1102, which are disposed in parallel. In terms of the primary scanning direction of the head, each ink supply opening H1102 is sandwiched by two sets of electro-thermal transducing elements H1103 disposed in a straight line, and two sets of ejection orifices H1107 disposed in a straight line. Disposed also on the recording element substrate H1101 are electrical wiring, fuses, electrodes H1104, etc. The ink jet cartridge H1001 is also provided with such structural components having ink passages H1106 and ejection orifices H1107 and formed of a resinous substance by photolithography, in a manner of covering the above-mentioned components. The electrodes H1104 for supplying ink jet recording head with electrical power through the electrical wires are provided with bumps H1105 formed of gold or the like.

(1-2) Electric Wire Tape

The electric wire tape H1301 constitutes passages for the electrical signals applied to the recording element substrate H1101 to eject ink. It has an opening H1303 in which the recording element substrate H1101 is fitted. In the adjacencies of the edges of this opening, electrical terminals H1304 connected to the electrodes H1104 of the recording element substrate H1101 are disposed. The electric wire tape H1301 is also provided with an external signal input terminal H1302 for receiving the electrical signals from the main assembly of the recording apparatus. The electrical terminal H1304 and external signal input terminal H1302 are connected with a continuous wiring pattern formed of copper foil.

As for the electrical connection between the electric wire tape H 1301 and the recording element substrate H1101, the bumps H1105 of the electrodes H1104 of the recording element substrate H1101 are connected to the electrical terminals H1304 of the electric wire tape H1301, which correspond to the electrodes H1104 of the recording element substrate H1101, by an ultrasonic welding method.

(1-3) Ink Supply Holding Member

The ink supply holding member H1501 is molded of a resinous substance, for example. As for the resinous material for the ink supply holding member H1501, it is desired that a resinous substance, into which glass filler has been mixed by 5-40% to improve the material in rigidity, is used as the material thereof. Referring to FIGS. 3A and 3B, the ink supply holding member H1501 comprises three independent spaces, in which the ink absorbent members H1601, H1602, and H1603 are held to internally hold three inks, one for one, different in color, and also, to generate negative pressure, functioning thereby as an ink container. Further, the recording element substrate H1101 is provided with a plurality of ink passages, which are independent from each other, and lead to the ink supply openings H1102, being thereby given the ink supplying function. The ink absorbent members H1601, H1602, and H1603 are formed of polypropylene fiber (which hereinafter will be abbreviated as PP fiber), and kept in a compressed state. However, they may be formed of urethane fiber. The ink absorbent members H1601, H1602, and H1603 are provided with filters H1701, H1702, and H1703, respectively, for preventing foreign debris from entering the recording element substrate H1101. The filters H1701, H1702, and H1703 are welded to the upstream sides of the ink absorbent members H1601, H1602, and H1603, in terms of the direction of the ink flow. Each filter may be a mesh type metallic filter formed of stainless steel. However, a metallic filter formed of stainless steel fiber, by sintering, is preferable.

The ink supply holding member H1501 is also provided with a plurality of ink supply openings H1201 for supplying the recording element substrate H1101 with each of the plurality of inks. The ink supply openings H1201 are located on the downstream side of the recording element substrate H1101. Referring to FIG. 4, the recording element substrate H1101 is solidly adhered to the ink supply holding member H1501, so that the former is precisely positioned relative to the latter in order to assure that each of the ink supply openings H1102 of the recording element substrate H1101 connects to the corresponding ink supply opening H1201 of the ink supply holding member H1501. The adhesive (first adhesive) used for this adhesion is desired to be low in viscosity, low in hardening temperature, short in hardening time, relatively high in hardness after curing, and also, resistant to ink. For example, a thermally curable adhesive, the main ingredient of which is epoxy resin, may be used as the first adhesive. The thickness of the adhesive layer is desired to be roughly 50 μm.

Figure 5:
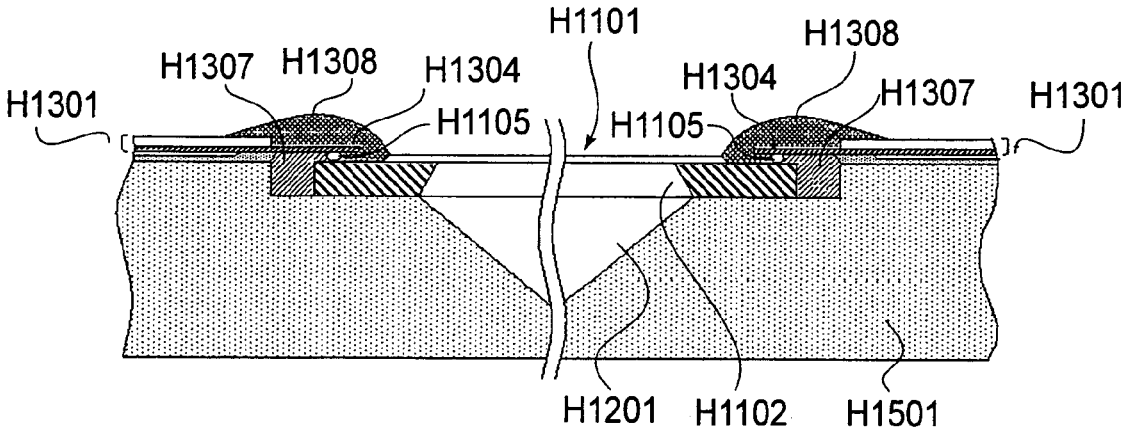
FIG. 5 is an enlarged sectional view of a part of the ink jet recording head in accordance with the present invention.

On the flat edge portion of the ink supply opening 1201, a part of the electric wire tape H1301 is located, which is solidly adhered thereto by the back surface, with the use of another adhesive (second adhesive). The electrical connection between the recording element substrate H1101 and electric wire tape H1301 is sealed with a first sealant H1307 and a second sealant H1308 (FIG. 5), being prevented from being corroded by ink and/or from being damaged by external impact. The first sealant H1307 primarily seals the back side of the connection between the electrical terminal H1304 of the electric wire tape H1301 and the bump H1105 of the recording element substrate H1101, and the peripheries of the recording element substrate H1101, whereas the second sealant H1308 seals the front side of the above-mentioned connection. The portion of the electric wire tape H1301 which is not adhered to the recording element substrate H1101 is perpendicularly bent at a predetermined line, and the opposite side of the electric wire tape H1301 from this predetermined line is fixed to the lateral surface of the ink supply holding member H1501, which is roughly perpendicular to the surface having the ink supply openings 1201, by thermal crimping, the use of adhesive, or the like means.

(1-4) Cover

The cover H1901 shown in FIGS. 3A and 3B is a component that is welded to the edges of the top opening of the ink supply holding member H1501 to seal the independent spaces in the ink supply holding member H1501, although the cover H1901 is provided with minute openings H1911, H1912, and H1913 for preventing the above-mentioned internal spaces (chambers) of the ink supply holding member H1501 from changing in internal pressure, and minute grooves H1921, H1922, and H1923, which are connected to the openings H1911, H1912, and H1913, respectively, at one end. The other ends of the minute grooves H1921 and H1922 connect to the mid portion of the minute groove H1923. The minute openings H1911, H1912, and H1913, and virtually the entireties of the minute grooves H1921, H1922, and H1923, are covered with a sealing member H1801, with only the other end of the minute groove H1923 being exposed to be used as an air vent. Further, the cover H1901 is provided with a locking member H1930 used for locking the ink jet cartridge H1001 to the main assembly of an ink jet recording apparatus.

Figure 6:
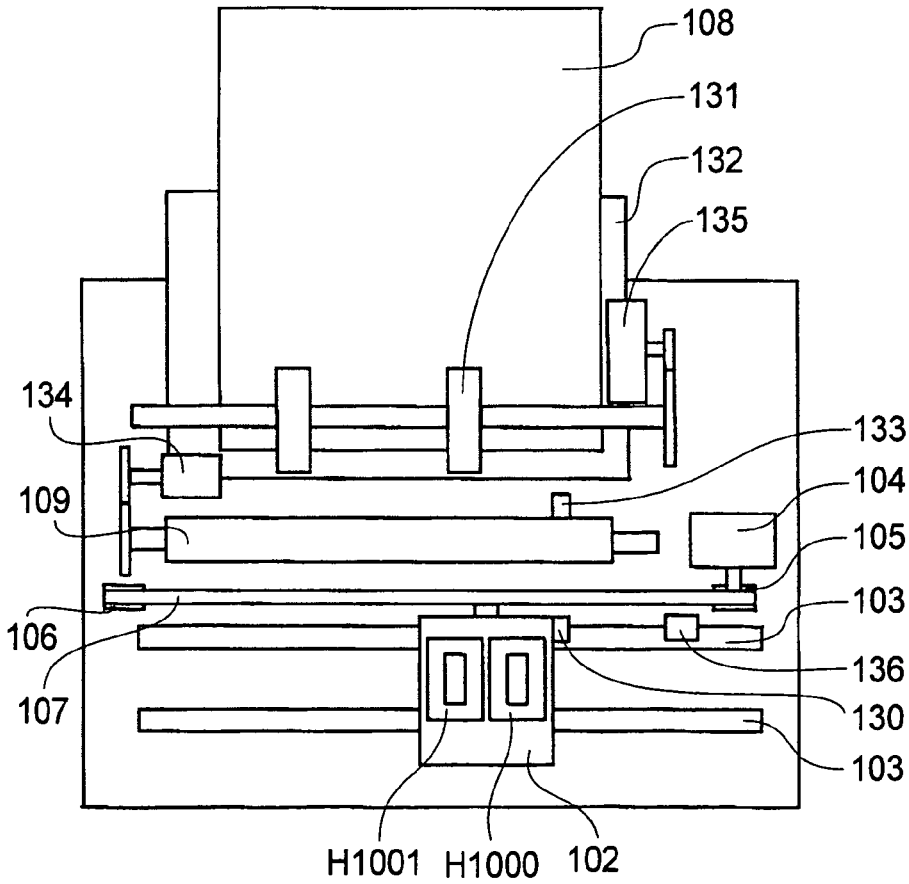
FIG. 6 is a schematic drawing of an ink jet recording apparatus which employs the ink jet cartridge shown in FIGS. 2A and 2B.

(1-5) Mounting of Ink Jet Cartridge into Ink Jet Recording Apparatus Main Assembly Referring to FIGS. 2A and 2B, the ink jet cartridge H1001 is provided with: a guide H1560 for guiding the ink cartridge H1001 into a predetermined position on the carriage 102 of the main assembly of the ink jet recording apparatus, shown in FIG. 6; the ink jet cartridge locking member H1930 for locking the ink jet cartridge to the carriage 102 in coordination with an unshown headset lever; a positioning bump H1570 for precisely positioning the ink jet cartridge H1001 relative to the carriage 102 in the X direction (primary scanning direction); a positioning bump H1580 for precisely positioning the ink jet cartridge H1001 relative to the carriage 102 in the Y direction (recording medium conveyance direction); a positioning bump 1590 for precisely positioning the ink cartridge H1001 relative to the carriage 102 in the Z direction (ink ejection direction). As the ink jet cartridge H 1001 is precisely positioned relative to the carriage 102 by being placed in contact with all of the above-mentioned positioning bumps H1570, H1580, and H1590, the external signal input terminals H1302 of the electric wire tape H1301 are precisely placed in contact with contact pins (unshown) of an electrical contact portion disposed within the carriage 102, establishing thereby the electrical connection between the ink jet cartridge and the main assembly. Given above is the description of the structure of the ink jet cartridge in accordance with the present invention, which cartridge is integral with ink containers. However, the present invention is also compatible with an ink jet cartridge, the ink holding portion (ink container) of which is separable from the portion (ink jet recording head) thereof having the recording element substrate, as long as the ink jet cartridge is agreeable with the technical gist of the present invention. Incidentally, designated by a reference symbol H1000 is an ink jet cartridge which stores only black ink (FIG. 6).

(2) Ink Jet Recording Apparatus

Next, a typical ink jet recording apparatus, in which an ink jet cartridge such as the above-described one is mountable, will be described. FIG. 6 is a schematic drawing of an example of a recording apparatus in which the ink jet cartridge H1001 in accordance with the present invention, and the ink jet cartridge H1000 which stores only black ink, are mountable.

The ink jet recording apparatus shown in FIG. 6 employs the ink jet cartridge shown in FIGS. 2A and 2B, which is removably mountable on the carriage 102. In the drawing, the ink jet cartridge H1001 has been precisely positioned relative to the carriage 102. The carriage 102 is provided with the electrical contact portion for transmitting driving signals or the like to each liquid ejecting portion through the external signal input terminals of the recording head cartridges H1000 and H1001.

The main assembly of the image forming apparatus (ink jet recording apparatus) is provided with a guiding shaft 103 which extends in the primary scanning direction, and the carriage 102 is supported by the guiding shaft 103, being enabled to shuttle along the guiding shaft 103. More specifically, the carriage 102 is controlled in position and movement by being driven by a primary scan motor 104 through the driving mechanism made up of a motor pulley 105, a follower pulley 106, a timing belt 107, etc. The carriage 102 is provided with a home position sensor 130 so that as the home position sensor 130 on the carriage 102 moves past a shielding plate 136, the position of the carriage 102 is detected.

Recording mediums 108, such as sheets of printing paper, thin plastic plate, etc., are fed, while being separated one by one, into the main assembly of the image forming apparatus, from an automatic feeder (AFS) 132 by rotating a pickup roller 131 by a paper feeding motor 135 through a gear train. Then, each recording medium 108 is conveyed (in the secondary scan direction) by the rotation of a conveyance roller 109 through the position (printing portion) in which the recording medium 108 squarely faces the ink ejecting surfaces of the ink jet recording heads of the ink jet cartridges H1000 and H1001. The conveyance roller 109 is driven by the rotation of an LF (line feed) motor 134 through a gear train. Whether or not each recording medium 108 has just been fed, and whether or not the leading edge of the fed recording medium 108 is accurately positioned for image formation, are confirmed as each recording medium 108 moves past a paper end sensor 133. The paper end sensor 133 is also used to detect the actual position of the trailing edge of the recording medium 108, in order to precisely calculate the current printing point of the recording medium 108 based on the detected actual position of the trailing edge of the recording medium 108.

The recording medium 108 is supported by a platen (unshown) at its back surface, so that the printing surface of the recording medium 108 is kept flat at the printing portion. More specifically, the liquid ejecting sides of the ink jet recording heads of the ink jet cartridges H1000 and H1001 mounted on the carriage 102 project downward from the carriage 102 so that the liquid ejecting surfaces of the ink jet recording heads are positioned parallel to the portion of the recording medium 108 that is between two pairs of conveyance rollers.

The ink jet recording heads of the ink jet cartridges H1000 and H1001 are mounted on the carriage 102 so that the direction in which the ejection orifices H1107 are aligned becomes intersectional to the primary scan direction of the carriage 102. Recording is made by ejecting ink from these ejection orifices H1107.

Given above are the descriptions of the basic structures of the ink jet cartridge and ink jet recording apparatus in accordance with the present invention. Next, the portions of the ink jet cartridge and ink jet recording apparatus in accordance with the present invention, which characterize the present invention, will be described in detail, while comparing the preferred embodiments of the present invention to comparative ink jet cartridges and ink jet recording apparatuses.

COMPARATIVE EXAMPLE

FIG. 7A shows a comparative ink jet cartridge H1002 manufactured with the use of the same method as that used for manufacturing the above-described ink jet cartridge H1001, and FIG. 7B shows the arrangement of the ejection orifices on the recording element substrate H1202 mounted in the ink jet cartridge H1002, as it is seen from the direction indicated by the arrow mark in FIG. 7A. The first and second sets 302 and 303 of ejection orifices, third and fourth sets 304 and 305 of ejection orifices, and fifth and sixth sets 306 and 307 of ejection orifices, are disposed in a straight line, in a manner of sandwiching the corresponding ink supply opening 308. This structural arrangement makes it possible to supply three inks different in type, through the three ink supply openings 308, one for one. Each of the ejection orifices making up the first, third, and fifth ejection orifice sets 302, 304, and 306 is formed so that its size is suitable for ejecting ink droplets which are 5 pl in volume, and the measurements of the ink passage leading thereto and the measurements of the electro-thermal transducing element therefor are adjusted accordingly, whereas each of the ejection orifices making up the second, fourth, and sixth ejection orifice sets 303, 305, and 307 is formed so that its size is suitable for ejecting ink droplets which are 2 pl in volume, and the measurements of the ink passages leading thereto and the measurements of the electro-thermal transducing element therefor are adjusted accordingly.

Figure 9:
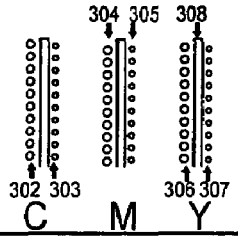
FIG. 9 is a table showing the results of the tests carried out to compare, in terms of nonuniformity, the plurality of images formed using the comparative ink jet cartridge.
Figure 9:
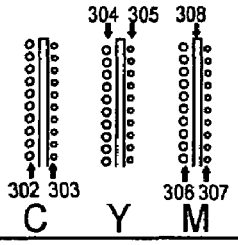

FIG. 9 shows the results of the recording tests which were carried out to confirm the relationship between the positioning of the ejection orifice sets 302-307 for ejecting ink droplets and the level of nonuniformity of images produced by the ejected ink droplets, and in which two among yellow (which hereinafter will be referred to simply as Y), cyan (hereinafter, C), and magenta (hereinafter, M) inks were used for image formation, with the combinations of the inks ejected from the ejection orifices set as follows. More specifically, after a solid image was formed at a duty of 50% by scanning the recording medium (PR-101: product of Canon Inc.) once in a predetermined direction, the image on the recording medium was read by a scanner (CanoScan LIDE80: product of Canon Inc.), and then, was turned into a grey monochromatic image with the use of an image processing software (Photoshop 7.0.1: product of Adobe System Co., Ltd.). Then, the resultant image was evaluated using a scale of three grades The images whose nonuniformity was virtually undetectable, as is the nonuniformity of the solid image in FIG. 8A, were evaluated as "circle," the images which suffered from a relatively small amount of nonuniformity, as does the solid image in FIG. 8B, were evaluated as "triangle," and the images whose nonuniformity was clearly confirmable, as is the nonuniformity of the solid image in FIG. 8C, were evaluated as "cross."

The distance d1 between the fourth set 305 of ejection orifices and sixth set 307 of ejection orifices (straight line which connects the center of each of the ejection orifices making up the fourth set 305 of ejection orifice, and the center of the corresponding ejection orifice of the sixth ejection orifice set 307, and which is parallel to the primary scan direction) is equal to the distance between the second and fourth ejection orifice sets 303 and 305, which is 2.371 mm, and the distance d2 between the second and sixth ejection orifice sets 303 and 307 is 4.742 mm.

The results were: When the yellow ink, which is high in lightness, was used in combination with one of the other inks, virtually no nonuniformity was detected, and there was virtually no difference in terms of nonuniformity between the images formed by the combination of the yellow ink and one of the other inks, and the images formed by the combination of the yellow ink and the remaining inks. However, when the combination of the cyan and magenta inks, which are low in lightness, was used, the resultant images suffered from clearly detectable nonuniformity. Further, it became evident that the longer the distance between the two sets of ejection orifices used for image formation, the more likely it was for nonuniform images to be formed, for the following reason.

That is, when the distance between the two sets of ejection orifices used for image formation is long, the satellite ink droplets which form as primary ink droplets are ejected from the two sets of ejection orifices, are carried by the unstable flow of gas (air), which occurs in the space between the ejection orifices for ejecting ink droplets, and the recording medium, contributing to the formation of a nonuniform image. In comparison, when the distance between the two sets of ejection orifices used for image formation is short, this short distance seems to be effective to reduce the ratio at which the satellite ink droplets form as primary ink droplets are ejected from the two sets of ejection orifices, making it thereby more difficult for a nonuniform image to be formed, even though the volume of the satellite ink droplets formed is virtually the same as the volume of the satellite ink droplets formed when the distance is long.

It should be noted here that in the case of the ink combination in which one of the two inks is yellow ink, the yellow ink, which is relatively high in lightness, seems to be effective to render the nonuniformity inconspicuous, in spite of the fact that the volume of the satellite ink droplets formed remains virtually the same whether or not one of the inks of the ink combination is yellow.

Further, the above-described phenomenon was more conspicuous when the printing duty was in the range of 25-75%.

Next, the nozzle arrangement of the ink jet recording head in one of the preferred embodiments of the present invention, which is based on the knowledge obtained through the above-described tests, will be described in detail. If a given component in one of the preferred embodiments of the present invention is identical in function to a component in another preferred embodiment, the two components will be designated by the same reference symbol.

Embodiment 1

In this embodiment, the ink jet recording head was enabled to eject plural types of ink droplets, that is, ink droplets different in size, more specifically, ink droplets which are 5 pl in volume, and ink droplets which are 2 pl in volume, and was structured so that the ejection orifice group for ejecting cyan ink droplets, which were 2 pl in volume, and the ejection orifice group for ejection magenta ink droplets, which were 2 pl in volume, were disposed as close as possible to each other, in consideration of the results of the tests carried out using the above-described comparative ink jet recording head. It is unnecessary that all the ink droplets ejected from one group of ejection orifices be 5 pl in volume, and all the ink droplets ejected from the other group of ejection orifices be 2 pl in volume; all that is necessary is that they are roughly 5 pl and 2 pl in volume, respectively. As for the specific method for varying the ejection orifices in respect of the volume of the ejected ink droplets, various known methods are available. For example, the volume of ink droplets ejected from the ejection orifices can be varied by varying the ejection orifices in respect of the size of their openings; when the opening of each ejection orifice is circular, the volume of ink droplets ejected can be varied by varying the diameter of the opening of each ejection orifice. Next, the effects of the difference in the type of the color ink, supplied to each of the groups of ejection orifices from which ink droplets which are 2 pl in volume are ejected, upon how the nonuniformity of an image appears to the human eye will be confirmed.

Figure 10A:
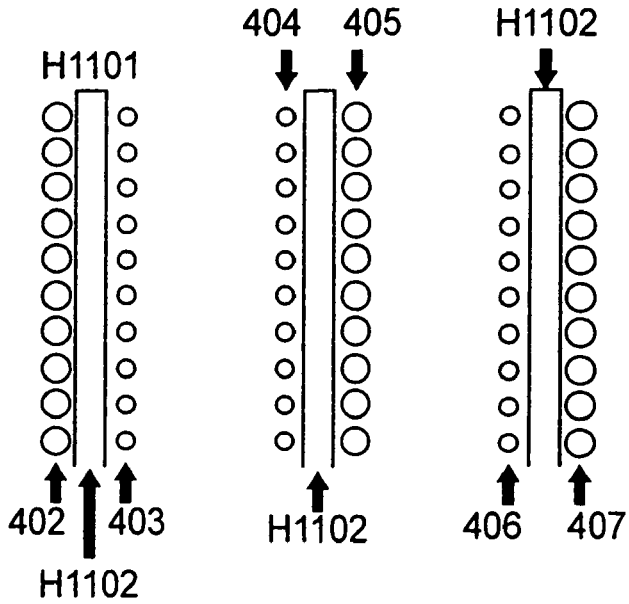
FIG. 10A is a schematic drawing showing the arrangement of the plurality of sets of ejection orifices in the first embodiment of the present invention.

FIG. 10A shows the positioning of the recording element substrate H1101 of the above-described ink jet cartridge H1001 in this embodiment, as the substrate H1101 is seen from the direction indicated by the arrow marks in FIGS. 2A and 3A. Here, the ejection orifice groups H1108, each of which is made up of a plurality of the above-described ejection orifices H1107 (FIG. 4), will be referred to as the first ejection orifice group 402, the second ejection orifice group 403, the third ejection orifice group 404, the fourth ejection orifice group 405, the fifth ejection orifice group 406, and the sixth ejection orifice group 407, counting from the left side of the drawing (FIG. 10A). The distances among the ejection orifice groups are the same as those of the above-described comparative ink jet recording head. That is, the distance between the second ejection orifice group 403 and third ejection orifice group 404 is 2.138 mm, and the distance between the third ejection orifice group 404 and fifth ejection orifice group 406 is 2.371 mm. The distance between the second ejection orifice group 403 and fifth ejection orifice group 406 is 4.509 mm. Further, the first and second ejection orifice groups 402 and 403, the third and fourth ejection orifice groups 404 and 405, and the fifth and sixth ejection orifice groups 406 and 407, are positioned so that they oppose each other across the corresponding ink supply opening H1102. The ejection orifice groups 402-406 are parallel to each other. This structural arrangement makes it possible for three inks different in type to be supplied through the three ink supply openings H1102, one for one; two ejection orifice groups positioned so that they oppose each other across one of the ink supply openings H1102, are supplied with ink of the same color through the ink supply opening which they sandwich. In other words, the first and second ejection orifice groups 402 and 403 eject the same color of ink, and the third and fourth ejection orifice groups 404 and 405 eject the same color of ink. Further, the fifth and sixth ejection orifice groups 406 and 407 eject the same color of ink. Moreover, each of the ejection orifices of the first, fourth, and sixth ejection orifice groups 402, 405, and 407 is formed so that it can eject ink droplets which are 5 pl in volume, and the measurements of the ink passage leading thereto, and the measurements of the electro-thermal transducing element therefor are adjusted accordingly, whereas each of the ejection orifices of the second, third, and fifth ejection orifice groups 403, 404, and 406 is formed so that its size is suitable for ejecting ink droplets which are 2 pl in volume, and the measurements of the ink passage leading thereto and the measurements of the electro-thermal transducing element therefor are adjusted accordingly.

Figure 10B:
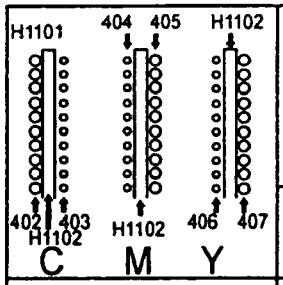
FIG. 10B is a table showing the results of the tests carried out to compare, in terms of nonuniformity, the plurality of images formed using the ink jet cartridge in the first embodiment.
Figure 10B:
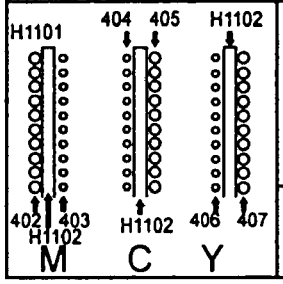

FIG. 10B shows the results of the recording tests, similar to the tests carried out using the above-described comparative ink jet recording head, in which two among yellow (which hereinafter will be referred to simply as Y), cyan (hereinafter, C), and magenta (hereinafter, M) inks were used for image formation, and in which the combinations of the inks ejected from the ejection orifices were set as follows. As will be evident from Figure, such nonuniformity as that found in the images in FIGS. 8B and 8C was not found in the images formed with the use of the ink jet cartridge H1001 in the first embodiment, even when images were formed using the combination of the magenta and yellow inks; satisfactory images were formed.

Further, when the distance between the second and third ejection orifice groups 403 and 404, the distance between the third and fifth ejection orifice groups 404 and 406, and the distance between the second and fifth ejection orifice groups 403 and 406, were changed to 1.135 mm, 1.397 mm, and 2.532 mm, respectively, while keeping virtually the same the basic structure of the ink jet cartridge, such nonuniformity as that found in the images in FIGS. 8B and 8C was not found in the images formed with the use of this ink jet cartridge, just as such nonuniformity was not found in the case of the ink jet cartridge in this embodiment, even when the combination of the magenta and cyan inks was used for image formation; satisfactory images were formed.

Embodiment 2

Figure 11A:
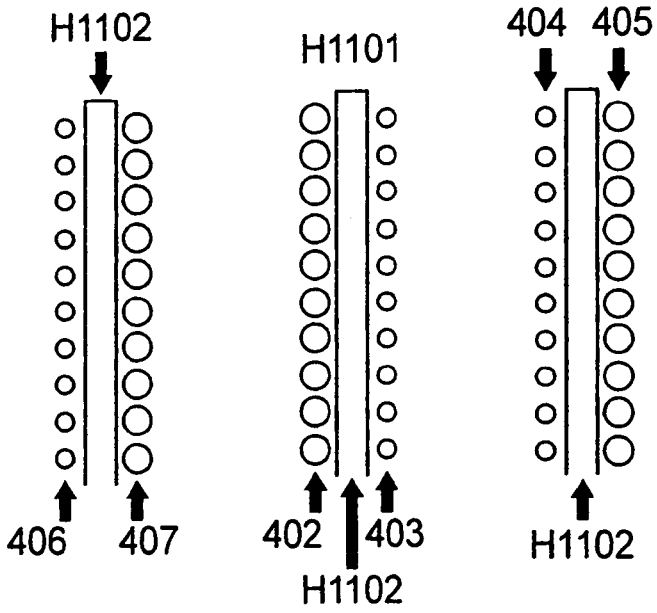
FIG. 11A is a schematic drawing showing the arrangement of the plurality of sets of ejection orifices in the second embodiment of the present invention.

FIG. 11A shows the positioning of the ejection orifice groups of the recording element substrate H1101 of the ink jet cartridge H1001 in the second embodiment, as the substrate H1101 is seen from the direction indicated by the arrow marks in FIGS. 2A and 3A.

This embodiment is different in nozzle arrangement from the first embodiment in that the fifth and sixth nozzle lines were placed on the left side (FIGS. 10A and 11A) of the first nozzle line (leading end side of the carriage in terms of the scanning direction of the carriage when the ink jet cartridge is used in the ink jet recording apparatus shown in FIG. 6).

Figure 11B:
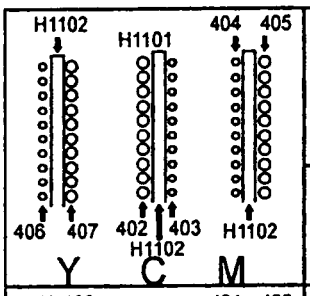
FIG. 11B is a table showing the results of the tests carried out to compare, in terms of nonuniformity, the plurality of images formed using the ink jet cartridge in the second embodiment.
Figure 11B:
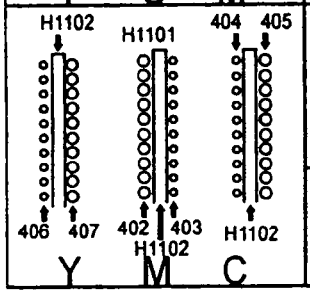

This ink jet recording head was used to form the same images as those formed by the comparative ink jet recording head, using two inks among the yellow (which hereinafter will be referred to simply as Y), cyan (hereinafter, C), and magenta (hereinafter, M) inks, with the ink to be ejected from each ink ejection orifice group as follows. The results are shown in FIG. 11B. As will be evident from FIG. 11B, such nonuniformity as that found in the images in FIGS. 8B and 8C was not found in the images formed with the use of the ink jet recording head in the second embodiment, as it was not found in the images formed by the ink jet recording head in the first embodiment, even when images were formed using the combination of the magenta and yellow inks; satisfactory images were formed.

The effects of the present invention can be accomplished by either the first or second embodiment. However, the structural arrangement in which the distance between the line of nozzles which eject small yellow ink droplets and the lines of nozzles which eject small ink droplets of other colors is shorter is more desirable. From this point of view, the first embodiment may be said to be superior in structural arrangement to this embodiment.

It is reasonable to think that if the ink jet recording apparatus shown in FIG. 6 is operated so that recording is made only when its carriage is moved in one direction, that is, recording is not made when its carriage is moved in the opposite direction, the more upstream (closer to the leading end of the carriage) a given line of ejection orifices is, in respect of the direction in which the carriage is moved while recording is actually made, the less likely it is for the ink droplets ejected from the given line of ejection orifices to be affected by the unstable flow of gas (air). Therefore, in order to prevent the formation of an image suffering from nonuniformity attributable to the unstable flow of gas, which occurs in the space between the ink jet recording head surface having the ejection orifice of each of the nozzles for ejecting ink droplets, and the recording medium, it is desired that when using a plurality of inks different in type, the line of ejection orifices which eject the ink which is thought to be the one that is most likely to render the nonuniformity of an image conspicuous, that is, the ink with the lowest lightness, be positioned most upstream in respect of the direction in which the carriage is moved while actually recording (the leading end of carriage in respect of the direction in which the carriage is moved while actually recording). Also from this standpoint, the first embodiment may be said to be superior to the second embodiment.

The cyan and magenta inks are both extremely low in lightness compared to the yellow ink. However, when the cyan and magenta inks are compared to each other, the cyan ink is slightly lower in lightness than the magenta ink. Thus, even in the case of the first embodiment, a positioning of the ejection orifice groups such that the cyan ink, that is, the ink lowest in lightness, is ejected by the first and second ejection orifice groups, the magenta ink is ejected by the third and fourth ejection orifice groups, and the yellow ink is ejected by the fifth and sixth ejection orifice groups is the best positioning of the ejection orifice groups.

Embodiment 3

In this embodiment, the ejection orifices from which ink droplets which are 2 pl in volume are ejected are not disposed in a straight line, and the effect of the difference in the type of color ink supplied to the ejection orifice groups which eject ink droplets which are 2 pl in volume, upon how the nonuniformity of an image appears to the human eye is confirmed.

Figure 12B:
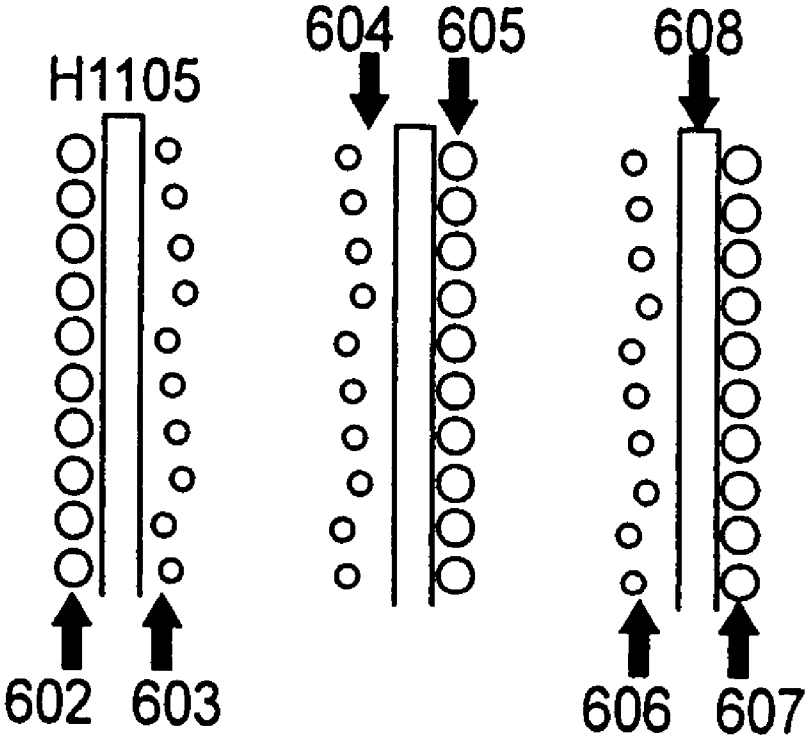
FIG. 12B is a schematic drawing showing the arrangement of the plurality of sets of ejection orifices, on the recording element substrate mounted in the ink jet cartridge in the third embodiment.
Figure 12A:
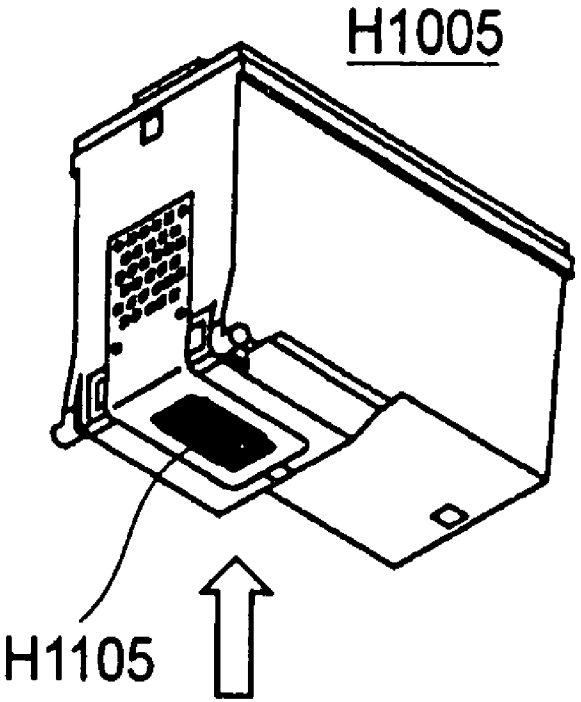
FIG. 12A is a perspective view of the ink jet cartridge in the third embodiment of the present invention.

FIG. 12A shows the ink jet cartridge H1005 manufactured using the same method as that used for manufacturing the above-described ink jet cartridge H1001, and FIG. 12B shows the ejection orifice arrangement on the recording element substrate H1105 mounted in the ink jet cartridge H1005, as the recording element substrate H1105 is seen from the direction indicated by the arrow mark in FIG. 12A. The first and second ejection orifice groups 602 and 603, the third and fourth ejection orifice groups 604 and 605, and the fifth and sixth ejection orifice groups 606 and 607, are positioned so that they oppose each other across the corresponding ink supply opening 608. This structural arrangement makes it possible for three inks different in type to be supplied through the three ink supply openings 608, one for one. Moreover, each of the ejection orifices of the first, fourth, and sixth ejection orifice groups 602, 605, and 607 is formed so that its size is suitable for ejecting ink droplets which are 5 pl in volume, and the measurements of the ink passage leading thereto and the measurements of the electrothermal transducing element therefor are adjusted accordingly, whereas each of the ejection orifices of the second, third, and fifth ejection orifice sets 603, 604, and 606 is formed so that its size is suitable for ejecting ink droplets which are 2 pl in volume, and the measurements of the ink passage leading thereto and the measurements of the electro-thermal transducing element therefor are adjusted accordingly. However, the ink jet cartridge in this embodiment is different from those in the first and second embodiments in that the ejection orifices of the ejection orifice groups 603, 604, and 606 for ejecting the small ink droplets are not disposed in a straight line. More specifically, the ejection orifices of each ejection orifice group are divided into a plurality of units, each of which comprises four ejection orifices, and the four ejection orifices of each unit are disposed in a straight line inclined at a predetermined slight angle relative to the ink supply opening 608, giving thereby an overall impression of slight snaking. In other words, each of the ejection orifice groups 603, 604, and 606 is made up of a plurality of ejection orifice units (in each of which a predetermined number (four) of ejection orifices is disposed in a straight line at a slight angle relative to the ink supply opening), which are chained in the direction parallel to the ink supply opening.

Driving the electro-thermal transducing elements in a time-sharing fashion in order to record an image prevents electrical current from being applied to all the electro-thermal transducing elements at the same time. Therefore, it offers such a benefit that the peak current value can be reduced, or the like. However, in the case of an ink jet cartridge such as those in the first and second embodiments, in which the ejection orifices of each ejection orifice group are disposed in a straight line, driving the electro-thermal transducing elements in a time-sharing fashion makes it rather difficult to print a long straight line. Therefore, this driving method is problematic in that it makes it difficult to form flawless tables or ruled lines. In comparison, an ink jet cartridge such as the one in this embodiment, shown in FIG. 12B, in which the ejection orifices of each of the ejection orifice groups 603, 604, and 606 are not disposed in a straight line, is thought to be effective to form flawless ruled lines.

Through the above-described three ink supply openings 608, cyan ink, magenta ink, and yellow ink were supplied, and images were formed by ejecting cyan ink droplets, magenta ink droplets, and yellow ink droplets, which were 2 pl in volume, from the second, third, and fifth ejection orifice groups 603, 604, and 606, respectively. Then, the images were compared to determine the effect of the color combination of the inks assigned to each of the ejection orifice groups upon the appearance of the nonuniformity of the images. The method used for recording was the same as that used in the first embodiment.

To describe the results, in the case of the ink jet cartridge structured so that cyan ink droplets which were 2 pl in volume were ejected from either the second ejection orifice group 603 or the third ejection orifice group 604, and magenta ink droplets which were 2 pl in volume were ejected from the rest of the ejection orifice groups, the nonuniformity of the produced images was virtually impossible to detect. The long straight lines (ruled lines) recorded by ink droplets which were 2 pl in volume were superior in terms of straightness to those recorded by the ink jet cartridge in the first embodiment.

As will be evident from the above description of the preferred embodiments of the present invention, not only is the present invention applicable to an ink jet recording head in which the ejection orifices are disposed in a straight line, but it is also applicable to an ink jet recording head, such as the one in this embodiment, in which the ejection orifices are divided into a plurality of units, each of which comprises a predetermined number of ejection orifices aligned at a predetermined angle, and which are chained in the direction parallel to an ink supply opening, arid also, an ink jet recording head, in which ejection orifices are disposed in a zig-zag pattern in order to increase the ejection orifice density.

Miscellaneous Embodiments

Given above are descriptions of the preferred embodiments of the present invention. However, these embodiments are not intended to limit the scope of the present invention. In other words, the present invention includes various modifications of the above embodiments as long as they are compatible with the technical gist of the present invention.

Figure 13B:
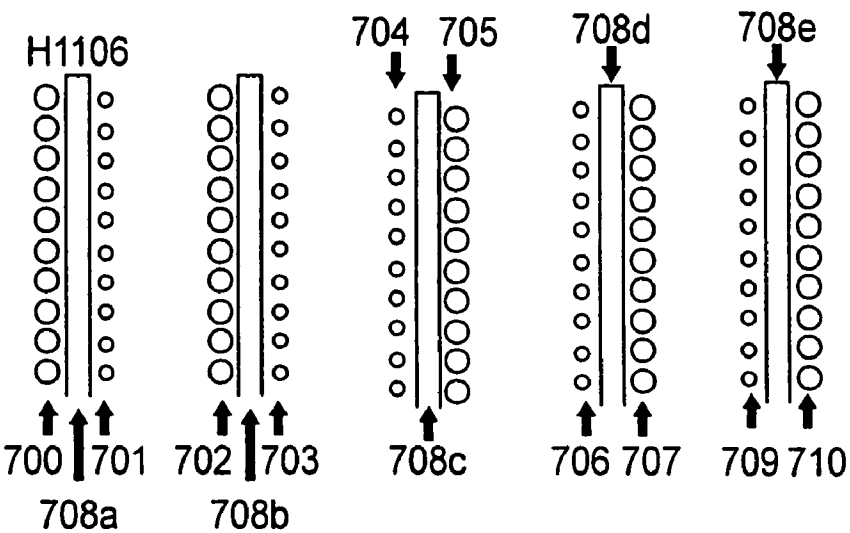
FIGS. 13A and 13B are schematic drawings showing the arrangement of the plurality of sets of ejection orifices, on the recording element substrate mounted in modifications of the ink jet recording head in accordance with the present invention.
Figure 13A:
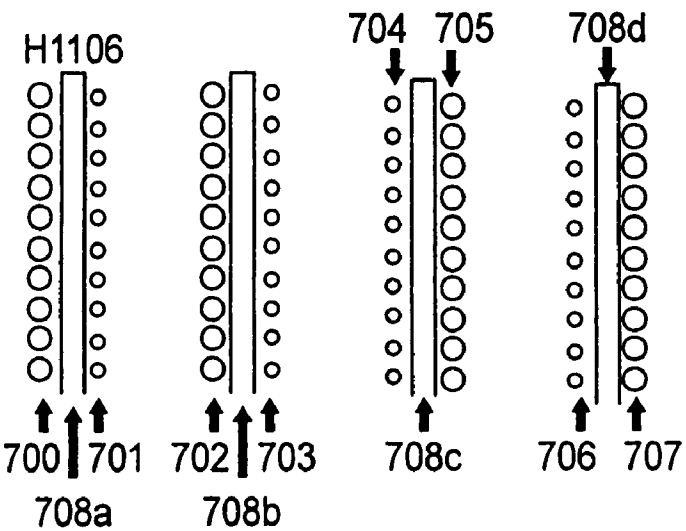

FIG. 13A shows a modification of the ink jet recording heads in the preceding embodiments, and FIG. 13B shows the ejection orifice arrangement of the ink jet recording head of FIG. 13A, as seen from the direction indicated by the arrow mark in FIG. 13A.

The ink jet recording head in FIG. 13A is provided with two more ejection orifice groups than the ink jet recording head in the first embodiment. The additional two ejection orifice groups are disposed most upstream (i.e., at the leading end of the ink jet recording head) in respect of the direction in which the carriage is moved while actually recording. Each of the ejection orifices of the first, third, sixth, and eighth ejection orifice groups 700, 702, 705, and 707 is formed so that it can eject ink droplets which are 5 pl in volume, and the measurements of the ink passage leading thereto and the measurements of the electro-thermal transducing element therefor are adjusted accordingly, whereas each of the ejection orifices of the second, fourth, fifth, and seventh ejection orifice groups 701, 703, 704, and 706 is formed so that its size is suitable for ejecting ink droplets which are 2 pl in volume, and the measurements of the ink passage leading thereto and the measurements of the electro-thermal transducing element therefor are adjusted accordingly. Designated by reference symbols 708*a*, 708*b*, 708*c*, and 708*d* are four ink supply openings, which are capable of supplying inks different in type, one for one.

In the case of this modification, the formation of images suffering from the nonuniformity attributable to secondary color(s) can be prevented by designing the ink jet recording head so that black ink is ejected from the first and second ejection orifice groups, cyan ink is ejected from the third and fourth ejection orifice groups, magenta ink is ejected from the fifth and sixth ejection orifice groups, and yellow ink is ejected from the seventh and eighth ejection orifice groups.

FIG. 13B shows another of the modifications of the preceding embodiments. The ink jet recording head of FIG. 13B is provided with two more ejection orifice groups than the ink jet recording head of FIG. 13A. The additional two ejection orifice groups are the ninth ejection orifice group 709, each ejection orifice of which is given the size suitable for ejecting ink droplets which are 2 pl in volume and the tenth ejection orifice group 710, each ejection orifice of which is given the size suitable for ejecting ink droplets which are 5 pl in volume. Designated by reference symbols 708*a*, 708*b*, 708*c*, 708*d*, and 708*e* are five ink supply openings, which are capable of supplying inks different in type, one for one.

Also in the case of this modification, the formation of images suffering from the nonuniformity attributable to secondary color(s) can be prevented by designing the ink jet recording head so that black ink is ejected from the first, second, ninth, and tenth ejection orifice groups, cyan ink is ejected from the third and fourth ejection orifice groups, magenta ink is ejected from the fifth and sixth ejection orifice groups, and yellow ink is ejected from the seventh and eighth ejection orifice groups.

When using only a single recording head to eject inks other than yellow, cyan, and magenta inks, in addition to the yellow, cyan, and magenta inks, it is desired that the lines of nozzles for ejecting small droplets of cyan ink, and the lines of nozzles for ejection small droplets of magenta ink, be placed next to each other, and the other lines of ejection orifices be placed outwardly (i.e., toward the outer edges of the ink jet recording head) relative to the lines of nozzles for ejecting the small droplets of cyan and magenta inks.

Further, in the case of the ink jet recording head in this modification of one of the preferred embodiments, in which, in principle, the additional ink, such as black ink, is not used for creating secondary color(s), it is desired that the positioning of the ejection orifice lines for ejecting yellow, magenta, and cyan inks not be altered, and the additional ejection orifice group(s) for ejecting the inks other than the yellow, magenta, and cyan inks, be placed on the outward sides of the ink jet recording head, relative to the ejection orifice groups for ejecting the yellow, magenta, and cyan inks. Further, from the standpoint that it is preferable to place the ejection orifice group(s) for ejecting the ink which is lowest in lightness, on the most upstream side (leading end of carriage) in respect of the direction in which the carriage is moved while actually recording, as it was in the case of the ink jet recording head in the second embodiment, it is preferable that the ejection orifice groups for ejecting black ink, that is, the ink which is lowest in lightness, be placed most upstream (i.e., at the leading end of the carriage) in respect of the direction in which the carriage is moved while actually recording, as shown in FIG. 13A.

As for the combination of the inks used by the ink jet recording head in accordance with the present invention, not only may it be the combination of yellow, magenta, and cyan inks, but also the combination of yellow, red, and magenta inks (yellow ink is higher in lightness than red and magenta inks), or the combination of yellow, green, and cyan inks (yellow ink is higher in lightness than green and cyan inks). In other words, the present invention is applicable when three inks different in color are used, and one of the inks is substantially higher in lightness than the other two.

Figure 14:
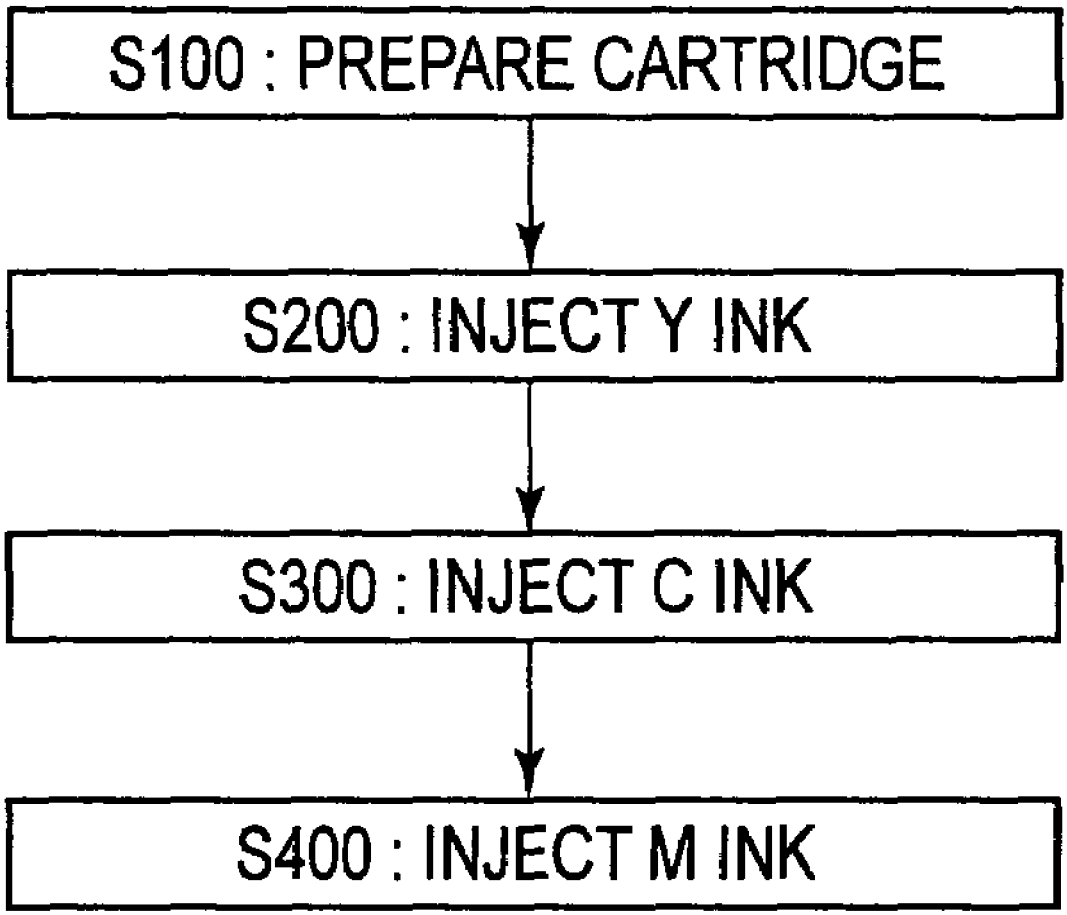
FIG. 14 is a flowchart of a method for filling the ink jet cartridge in accordance with the present invention, with ink.

FIG. 14 is a flowchart depicting the method for refilling a typical ink jet cartridge in accordance with the present invention, with inks. First, an ink jet cartridge such as the ink jet cartridge H1001 in which two ejection orifice groups, that is, groups 403 and 404, for ejecting smaller liquid droplets, are disposed between two ink supply openings, the ejection orifice groups 402 and 405 for ejecting larger liquid droplets are disposed on the opposite sides of the two ink supply openings from the ejection orifice groups 403 and 404, respectively, and the ejection orifice groups 406 and 407 for ejecting smaller liquid droplets and larger liquid droplets, respectively, are disposed across an additional ink supply opening, as shown in FIGS. 10A and 10B, is prepared (Step S100). This ink jet cartridge H1001 is provided with an ink storage chamber A for supplying the ejection orifice groups 406 and 407 with ink, an ink storage chamber B for supplying the ejection orifice groups 402 and 403 with ink, and an ink storage chamber C for supplying the ejection orifice groups 404 and 405.

Next, yellow ink is injected into the ink storage chamber A (Step S200). Thereafter, cyan ink is injected into either the ink storage chamber B or C (Step S300), and magenta ink is injected into the remaining ink storage chamber (Step S400). Steps S200-S400 do not need to be carried out in the above-mentioned order; the order in which they are carried out is variable. As for the method of injecting ink into the ink storage chambers, any of the known methods may be employed; for example, a pressuring method, or vacuum generating method.

By injecting ink as described above, it is possible to obtain an ink jet cartridge which ejects yellow ink from the ejection orifice groups 406 and 407, cyan ink from the ejection orifice groups 402 and 403, and magenta ink from the ejection orifice groups 404 and 405, or an ink jet cartridge which ejects yellow ink from the ejection orifice groups 406 and 407, cyan ink from the ejection orifice groups 404 and 405, and magenta ink from the ejection orifice groups 402 and 403. When using a used ink jet cartridge, it is desired that each ink storage chamber be filled with the same kind of ink as the ink with which it was previously filled.

While the invention has been described with reference to the structures disclosed herein, it is not confined to the details set forth, and this application is intended to cover such modifications or changes as may come within the purposes of improvements or the scope of the following claims.

This application claims priority from Japanese Patent Applications Nos. 164554/2004 and 144032/2005 filed Jun. 2, 2004 and May 17, 2005, respectively, which are hereby incorporated herein by reference.

What is claimed is:

1. An ink jet recording head comprising:

three sets of nozzle arrays, wherein one of said sets is adjacent each of the other two sets, wherein at least two of said sets of nozzle arrays comprises a large nozzle away which includes first ejection outlets for ejecting ink and a small nozzle array which includes second ejection outlets for ejecting the ink, said small nozzle away being adjacent to said large nozzle array, and said second ejection outlets having an ejection outlet diameter smaller than that of said first ejection outlets, wherein yellow, magenta and cyan inks are ejected to effect recording by said sets of nozzle arrays when said ink jet recording head is moved in a main scanning direction at a position opposing a recording material which is moved in a sub scan direction, wherein in nozzle arrays formed by two adjacent sets of said three sets of nozzle arrays, a large nozzle array, two small nozzle arrays which are immediately adjacent to each other, and a large nozzle array are arranged in the listed order, in the main scanning direction, and wherein one of said two adjacent sets of nozzle arrays ejects the cyan ink, and the other of said two adjacent sets of nozzle arrays ejects the magenta ink.

2. An ink jet recording head according to claim 1, wherein each of said sets of nozzle arrays includes an ink supply opening, between the large nozzle array and the small nozzle array, for supplying the ink to be ejected thereby.

3. An ink jet recording head according to claim 2, wherein the ink supply openings of said three sets of nozzle arrays are formed on a common substrate.

4. An ink jet recording head according to claim 1, wherein the nozzle arrays comprising said three sets of nozzle arrays are arranged in the order of a large nozzle array, a small nozzle array, a small nozzle array, a large nozzle array, a small nozzle array and a large nozzle array, as viewed from a leading side of scanning in the main scanning direction.

5. An ink jet recording head according to claim 1, further comprising a black nozzle array, disposed outside of said three sets of nozzle arrays, for ejecting black ink.

6. An ink jet recording head according to claim 5, wherein two black nozzle arrays are provided.

7. An ink jet recording apparatus comprising an ink jet recording head as defined in claim 1 and a carriage for scanningly moving said recording head.

8. An ink jet cartridge comprising:

an ink jet recording head for ejecting ink, said recording head comprising three sets of nozzle arrays, wherein one of said sets is adjacent each of the other two sets; and an ink accommodating portion for accommodating ink to be supplied to said ink jet recording head, wherein at least two of said sets of nozzle arrays comprises a large nozzle away which includes first ejection outlets for ejecting ink and a small nozzle array which includes second ejection outlets for ejecting the ink, said small nozzle away being adjacent to said large nozzle array, and said second ejection outlets having an ejection outlet diameter smaller than that of said first ejection outlets, wherein yellow, magenta and cyan inks are ejected to effect recording by said sets of nozzle arrays when said ink jet recording head is moved in a main scanning direction at a position opposing a recording material which is moved in a sub scan direction, wherein in nozzle arrays formed by two adjacent sets of said three sets of nozzle arrays, a large nozzle array, two small nozzle arrays which are immediately adjacent to each other, and a large nozzle array are arranged in the listed order, in the main scanning direction, and wherein one of said two adjacent sets of nozzle arrays ejects the cyan ink, and the other of said two adjacent sets of nozzle arrays ejects the magenta ink.

9. A method for injecting ink into an ink jet cartridge including an ink jet recording head for ejecting ink and an ink accommodating portion for accommodating ink to be supplied to the recording head, said method comprising:

a step of preparing the ink jet cartridge including three sets of nozzle arrays, wherein one of the sets is adjacent each of the other two sets, wherein at least two of the sets of nozzle arrays comprises a large nozzle away which includes first ejection outlets for ejecting ink and a small nozzle away which includes second ejection outlets for ejecting the ink, the small nozzle away being adjacent to the large nozzle array, and the second ejection outlets having an ejection outlet diameter smaller than that of the first ejection outlets, wherein yellow, magenta and cyan inks are ejected to effect recording by the sets of nozzle arrays when the ink jet recording head is moved in a main scanning direction at a position opposing a recording material which is moved in a sub scan direction, wherein in nozzle arrays formed by two adjacent sets of the three sets of nozzle arrays, a large nozzle array, two small nozzle arrays which are immediately adjacent to each other, and a large nozzle array are arranged in the listed order, in the main scanning direction, and wherein one of the two adjacent sets of nozzle arrays ejects the cyan ink, the other of the two adjacent sets of nozzle arrays ejects the magenta ink, and a set of nozzle arrays other than the two adjacent sets of nozzle arrays ejects the yellow ink;

a step of injecting the yellow ink into a first ink accommodating portion of the set of nozzle arrays other than the two adjacent sets of nozzle arrays of the ink jet cartridge;

a step of injecting the cyan ink into a second ink accommodating portion of one of the two adjacent sets of nozzle arrays; and a step of injecting the magenta ink into a third ink accommodating portion of the other one of the two adjacent sets of nozzle arrays.

* * * * *

UNITED STATES PATENT AND TRADEMARK OFFICE

CERTIFICATE OF CORRECTION

PATENT NO. : 7,384,129 B2
APPLICATION NO. : 11/141000
DATED : June 10, 2008
INVENTOR(S) : Nagata et al.

It is certified that error appears in the above-identified patent and that said Letters Patent is hereby corrected as shown below:

ON THE TITLE PAGE:
At Item (54), Title, "INK JET RECORDING HEAD, INK JET CARTRIDGE COMPRISING RECORDING HEAD, AND METHOD FOR REFILLING INK CARTRIDGE WITH INK" should read --INK JET RECORDING HEAD, INK JET CARTRIDGE COMPRISING RECORDING HEAD, AND METHOD FOR REFILLING INK JET CARTRIDGE WITH INK--.

COLUMN 1:
Line 4, "CARTRIDGE" should read --JET CARTRIDGE--.

COLUMN 10:
Line 65, "grades" should read --grades.--.

COLUMN 11:
Line 9, "orifice," should read --orifices,--.

COLUMN 16:
Line 7, "arid" should read --and--.

COLUMN 17:
Line 14, "ejection" should read --ejecting--.

COLUMN 18:
Line 41, "prises" should read --prise--, and "away" should read --array--.
Line 44, "away" should read --array--.

COLUMN 19:
Line 23, "away" should read --array--.
Line 26, "away" should read --array--.

COLUMN 20:
Line 8, "comprises" should read --comprise--, and "away" should read --array--.
Line 10, "away" should read --array--.
Line 11, "away" should read --array--.

Signed and Sealed this

Ninth Day of February, 2010

David J. Kappos

David J. Kappos
*Director of the United States Patent and Trademark Office*